US009816233B2

(12) United States Patent
Shi et al.

(10) Patent No.: US 9,816,233 B2
(45) Date of Patent: Nov. 14, 2017

(54) HYBRID FIBER COMPOSITIONS AND USES IN CONTAINERBOARD PACKAGING

(71) Applicants: Bo Shi, Neenah, WI (US); Mark M. Mleziva, Appleton, WI (US); Brent M. Thompson, Oshkosh, WI (US); Robert J. Zelenak, Appleton, WI (US)

(72) Inventors: Bo Shi, Neenah, WI (US); Mark M. Mleziva, Appleton, WI (US); Brent M. Thompson, Oshkosh, WI (US); Robert J. Zelenak, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 633 days.

(21) Appl. No.: 13/631,183

(22) Filed: Sep. 28, 2012

(65) Prior Publication Data

US 2014/0093704 A1 Apr. 3, 2014

(51) Int. Cl.

| | |
|---|---|
| ***D21H 11/12*** | (2006.01) |
| ***D21H 17/36*** | (2006.01) |
| ***B65D 65/38*** | (2006.01) |
| ***D21H 27/10*** | (2006.01) |
| ***D21H 17/28*** | (2006.01) |
| ***D21H 13/32*** | (2006.01) |
| *D21H 17/30* | (2006.01) |
| *B65D 65/46* | (2006.01) |

(52) U.S. Cl.

CPC ..... *D21H 17/36* (2013.01); *B65D 65/38* (2013.01); *D21H 11/12* (2013.01); *D21H 13/32* (2013.01); *D21H 17/28* (2013.01); *D21H 27/10* (2013.01); *B65D 65/466* (2013.01); *D21H 17/30* (2013.01); *Y10T 428/24694* (2015.01)

(58) Field of Classification Search

CPC ... Y10T 428/24694; B32B 3/28; B65D 65/38; B65D 65/36; B65D 65/466; D21H 11/12; D21H 13/32; D21H 17/28; D21H 17/30; D21H 17/36; D21H 27/10

See application file for complete search history.

(56) References Cited

U.S. PATENT DOCUMENTS

| | | | | |
|---|---|---|---|---|
| 1,829,852 A | | 11/1931 | Darling | |
| 2,388,592 A | | 11/1945 | Asplund et al. | |
| 2,862,813 A | | 12/1958 | Birdseye | |
| 2,965,436 A | | 12/1960 | De Domenico et al. | |
| 4,007,084 A | * | 2/1977 | Chan | D21H 17/49 162/167 |

(Continued)

FOREIGN PATENT DOCUMENTS

| | | |
|---|---|---|
| FR | 2 756 571 A1 | 6/1998 |
| GB | 508671 A | 7/1939 |

(Continued)

OTHER PUBLICATIONS

WO 2011/075830, Jun. 2011.*

*Primary Examiner* — Donald J Loney
(74) *Attorney, Agent, or Firm* — Kimberly-Clark Worldwide, Inc.

(57) ABSTRACT

The present invention relates to a containerboard packaging material comprising at least one non-wood alternative pulp material wherein said non-wood alternative pulp material is present in an amount of from about 5% to about 100% and wherein said material replaces at least a portion of conventional fiber materials.

12 Claims, 3 Drawing Sheets

(56) References Cited

U.S. PATENT DOCUMENTS

| | | | | |
|---|---|---|---|---|
| 4,040,899 | A | 8/1977 | Emerson | |
| 4,102,738 | A | 7/1978 | Dzurik | |
| 4,597,930 | A * | 7/1986 | Szal | D21H 5/1236 264/115 |
| 5,258,087 | A | 11/1993 | Symons | |
| 5,472,569 | A | 12/1995 | Nicolucci | |
| 5,500,086 | A | 3/1996 | Sakai | |
| 5,985,147 | A | 11/1999 | Jensen | |
| 6,074,856 | A | 6/2000 | Wong et al. | |
| 6,379,594 | B1 | 4/2002 | Döpfner | |
| 7,622,019 | B2 | 11/2009 | You | |
| 2004/0256065 | A1 | 12/2004 | Ahmed et al. | |
| 2006/0070295 | A1 | 4/2006 | Huang et al. | |
| 2006/0289135 | A1 * | 12/2006 | Grant | D21H 27/10 162/125 |
| 2007/0056702 | A1 | 3/2007 | Altheimer | |
| 2007/0062656 | A1 | 3/2007 | Murray et al. | |
| 2007/0202283 | A1 | 8/2007 | Meazle et al. | |
| 2008/0046277 | A1 * | 2/2008 | Stamets | A01N 63/04 705/308 |
| 2008/0057547 | A1 * | 3/2008 | You et al. | 435/101 |
| 2008/0081135 | A1 | 4/2008 | Spurrell | |
| 2008/0271866 | A1 | 11/2008 | Hong et al. | |
| 2010/0108279 | A1 | 5/2010 | Schall et al. | |
| 2011/0036525 | A1 | 2/2011 | Kim | |
| 2011/0052881 | A1 * | 3/2011 | Netravali | B32B 9/02 428/178 |
| 2011/0132559 | A1 | 6/2011 | Haehnle et al. | |
| 2011/0212293 | A1 | 9/2011 | Han et al. | |
| 2012/0006501 | A1 | 1/2012 | Golfman | |
| 2012/0018110 | A1 | 1/2012 | Jiang | |
| 2012/0046277 | A1 * | 2/2012 | Tsukamoto | C07D 307/79 514/218 |

FOREIGN PATENT DOCUMENTS

| | | | |
|---|---|---|---|
| GB | 702025 | A | 1/1954 |
| GB | 1 423 253 | A | 2/1976 |
| GB | 1 474 219 | A | 5/1977 |
| GB | 1 534 344 | A | 12/1978 |
| KR | 20070040551 | A | 4/2007 |
| KR | 20070040555 | A | 4/2007 |
| KR | 10-2010-0011771 | A | 2/2010 |
| WO | WO 1994/004745 | A1 | 3/1994 |
| WO | WO 2007/004757 | A1 | 1/2007 |
| WO | WO 2012/010181 | A1 | 1/2012 |
| WO | WO 2012/033998 | A2 | 3/2012 |
| WO | WO 2012/114045 | A1 | 8/2012 |
| WO | WO 2013/050436 | A1 | 4/2013 |

* cited by examiner

HYBRID FIBER COMPOSITIONS AND USES IN CONTAINERBOARD PACKAGING

FIELD OF THE INVENTION

The present invention relates to the use of non-wood alternative natural fibers in corrugated medium for containerboard packaging. A replacement of the conventional hardwood fiber is achieved by a hybrid fibrous composition that provides sufficient mechanical strength for containerboard packaging applications.

BACKGROUND OF THE INVENTION

Traditionally pulp derived from fast growing trees, such as pine, has been used as the raw material for containerboard packaging. The containerboard is comprised of linerboard and medium. The linerboard is usually made from softwoods, which have the longest fibers and produce the strongest containerboard. On the other hand, the medium is made from hardwood fibers, which tend to be shorter and stiffer than softwood fibers. In recent years, the use of recycled, old corrugated container (OCC) material has grown in popularity as a linerboard or corrugated medium because of concerns about environmental sustainability. However, the OCC frequently requires repulping and deinking processes. As such, the recycled fibers get shortened, weakened and contaminated as the number of recycles increase. Coupled with an increased demand and utilization of recycled fiber by many corrugated cardboard producers, the cost of recycled fiber has also increased. The move toward single stream recycling is causing an increase in contamination (staples, plastic tapes and hot melt adhesives) of the existing recovered fiber streams. Critical performance requirements such as strength (compression, edge crush, burst, and tensile strength), stiffness, or rigidity, moisture resistance, grease resistance and freeze/thaw tolerance can be more difficult to achieve with recycled paper or paperboard.

Hybrid fiber compositions comprising non-wood alternative natural fibers such as those derived from algae, corn stover, wheat straw, rice straw and the like would be an option to resolve such aforementioned issues. Fiber substitution in corrugated medium using land-based non-wood alternative fibers such as wheat straw alone may be challenged at a high level of inclusion. One of the factors is related to the fines associated with pulp fibers. Wheat straw fiber contains more fines (about 38-about 50%) than hardwood (about 20 to about 40%) or OCC (about 20-about 25%) fibers. This being the case, wheat straw fiber dimensions (fiber length and diameter) are comparable to hardwood fibers, such as those pulped from maple and oak, but shorter than OCC fibers due to the presence of softwood fibers in recycled containerboard materials. The fines could be viewed as a filler; however, having more fines from wheat straw pulp compared to others doesn't contribute to strength.

Red algae are one of the seaweeds, which belong to the division Rhodophyta, a part of Gelidiaceae family. Its fiber obtained after agar or bioethanol extraction has a high aspect ratio and surprisingly enhances corrugating medium mechanical properties such as tensile index, ring crush, burst index and tear index, etc. in hybrid fiber compositions. The presence of red algae fiber enables corrugated medium to meet or exceed the primary mechanical property requirements which, allows a high proportion of non-wood fibers, such as wheat straw, to be effectively utilized yet still fully meet product performance demands. Thus, the use of non-wood alternative fibers would be more eco-friendly, represent a significant shift from the use of conventional raw materials (hardwood pulp or OCC) and result in potential cost savings to various manufacturers.

Therefore, there exists a need for providing wood-alternative pulp materials to replace a portion of conventional fiber materials used in containerboard packaging. Additionally, there is a growing need for stronger, light weight corrugated materials that allow for packaging weight reduction. Although previous attempts to using alternative fibers to produce construction and furniture applied composite boards, there is a lack of sustainable attempts to produce non-wood natural fiber-based corrugated medium to be used in containerboard packaging applications. As a result, the present invention fills such gaps by providing wood-alternative materials that can be used for environmentally sustainable containerboard packaging.

SUMMARY OF THE INVENTION

The present invention relates to a containerboard packaging material comprising at least one non-wood alternative pulp material wherein said non-wood alternative pulp material is present in an amount of from about 5% to about 100% and wherein said material replaces at least a portion of conventional fiber materials. The hybrid fibrous composition can be processed by existing papermaking, fluting and case conversion machines for rigid packaging applications.

DETAILED DESCRIPTION OF THE INVENTION

Figure 1:
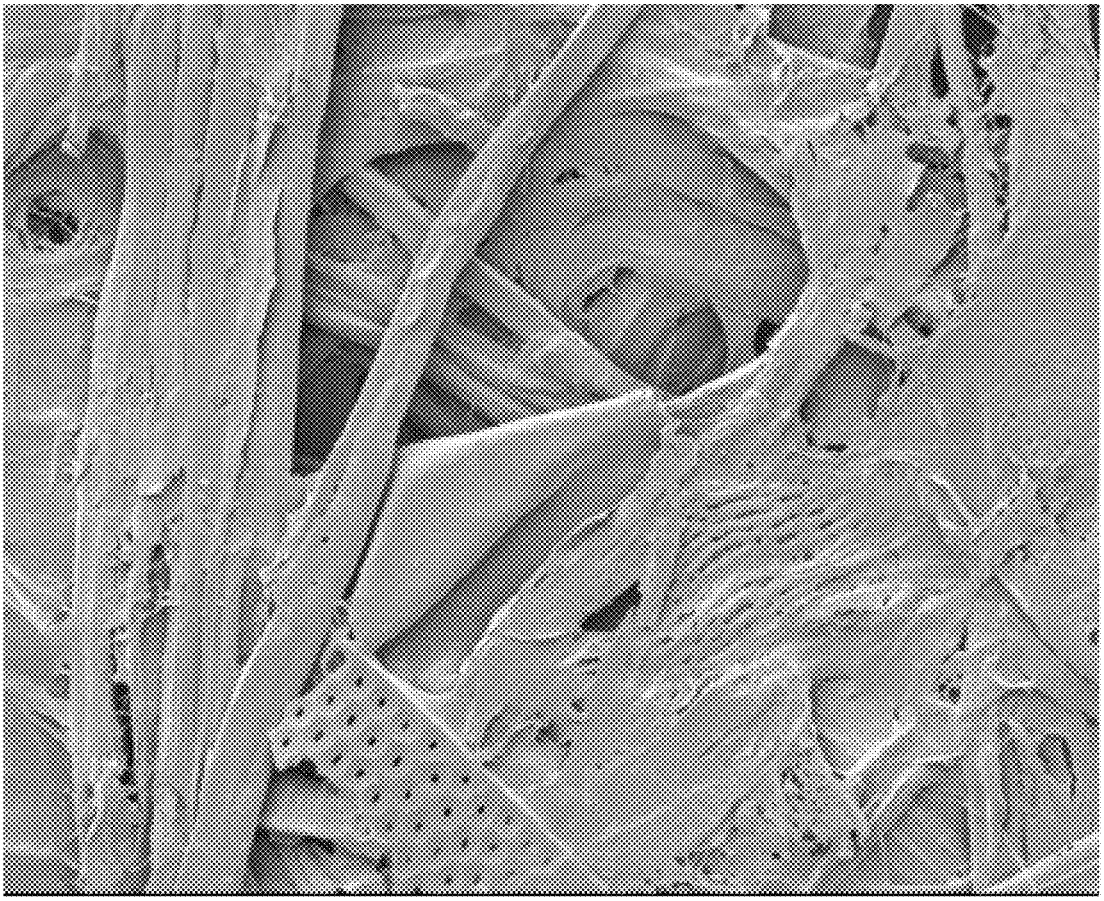
FIG. 1 shows a micrograph of 100% mixture of semi-chemical pulped hardwood short fiber in a handsheet surface SEM at 300×.

While the specification concludes with the claims particularly pointing out and distinctly claiming the invention, it is believed that the present invention will be better understood from the following description.

All percentages, parts and ratios are based upon the total weight of the compositions of the present invention, unless otherwise specified. All such weights as they pertain to listed ingredients are based on the active level and, therefore; do not include solvents or by-products that may be included in commercially available materials, unless otherwise specified. The term "weight percent" may be denoted as "wt. %" herein. Except where specific examples of actual measured values are presented, numerical values referred to herein should be considered to be qualified by the word "about".

As used herein, "comprising" means that other steps and other ingredients which do not affect the end result can be added. This term encompasses the terms "consisting of" and "consisting essentially of". The compositions and methods/processes of the present invention can comprise, consist of, and consist essentially of the essential elements and limitations of the invention described herein, as well as any of the additional or optional ingredients, components, steps, or limitations described herein.

As used herein, the term "non-wood" or "wood alternative" generally refers to processing residuals from agricultural crops such as wheat straw, wetland non-tree plants such as bulrush, aquatic plants such as water hyacinth, microalgae such as *Spirulina* and macroalgae seaweeds such as red or brown algae. Examples of non-wood natural materials of the present invention include, but are not limited to, wheat straw, rice straw, flax, bamboo, cotton, jute, hemp, sisal, bagasse, hesperaloe, switchgrass, miscanthus, marine or fresh water algae/seaweeds, and combinations thereof.

As used herein, the term "red algae fiber" refers to any cellulosic fibrous material derived from Rhodophyta. Particularly preferred red algae fiber include cellulosic fibrous material derived from *Gelidium amansii, Gelidium corneum, Gelidium asperum, Gelidium chilense* and *Gelidium robustum*. Red algae fibers generally have an aspect ratio (measured as the average fiber length divided by the average fiber width) of at least about 80.

As used herein, the term "OCC" refers to old corrugated containers that have layers of paper glued together with a fluted inner layer. This is the material used to make corrugated cardboard boxes (the most recycled product in the country). Four main components of the OCC pulps are unbleached softwood kraft pulp (mainly from the linerboard), semi-chemical hardwood pulp (from the fluted medium), starch (as an adhesive), and water (often 8% or more).

As used herein, the term "pulp" or "pulp fiber" refers to fibrous material obtained through conventional pulping processes known in the arts. This can be for woody and non-woody materials.

As used herein, the term "fines" refer to the fraction that passes through a 200 mesh screen (75 μm). The median size of fines is a few microns. Fines consist of cellulose, hemicellulose, lignin and extractives. There are two types of the fines: primary and secondary fines. The primary fines content seems to be a genetic characteristic of the plant. For hardwood pulp, it is about 20% to about 40%, whereas for wheat straw, it is about 38% to about 50%. The secondary fines are pieces of fibrils from the outer layers of fibers which are broken off during refining.

As used herein, the term "basis weight" generally refers to the weight per unit area of a linerboard or medium. Basis weight is measured herein using TAPPI test method T-220. A sheet of pulp, commonly 30 cm×30 cm or of another convenient dimension is weighed and then dried to determine the solids content. The area of the sheet is then determined and the ratio of the dried weight to the sheet area is reported as the basis weight in grams per square meter (gsm). Linerboard basis weight is at least about 130 grams per square meter (gsm) or greater and medium basis weight is about 90 gsm or greater. The moisture content for linerboard and medium is of less than about 10 percent.

As used herein, the term "containerboard" refers to a sheet containing linerboard as a facing and fluted medium. There are multiple configurations: single face, single wall, also called double face, double wall and triple wall for different product packaging applications.

As used herein, the term "flute" refers to refers to an inverted S-shaped "arch" or "wave" of a corrugated medium that normally runs parallel to the depth of the container and gives it the rigidity and crushing (stacking) strength. Flutes of the present invention may range from about 98 flutes per meter to about 492 flutes per meter. The major five classifications and sizes of flutes are: 1) A-flute: the highest arch size, between about 105 to about 121 flutes per meter, 2) B-flute: second highest arch size, about 148 to about 171 flutes per meter, 3) C-flute: intermediate between A and B, between about 128 to about 141 flutes per meter, 4) E-flute: has about 302 to about 322 flutes per meter, and 5) F-flute: the latest flute size, about 420 flutes per meter. These flutes may also be combined together to form multi-flute grades ranging from AAA (triple wall), AA (double wall) through E/F (Micro flute) combinations. Single flute heights range from A (0.477 cm) down to F (0.079 cm).

As used herein, the terms "single face", "single wall", "double wall" and "triple wall" refers packaging material formed by gluing one or more fluted sheets of paperboard (corrugating medium) between one or more linerboard facings. There are four common types:

1) "Single Face" refers to one fluted medium glued to one flat sheet of linerboard (total two sheets).
2) "Single Wall" refers to one fluted medium glued between two sheets of linerboard. Also known as "double face" (total three sheets).
3) "Double Wall" refers to two fluted mediums glued between three sheets of linerboard (total five sheets).
4) "Triple Wall" refers to three fluted mediums glued between four sheets of linerboard (total seven sheets).

As used herein, the term "Tensile Index" is expressed in N·m/g and refers to the quotient of tensile strength, generally expressed in Newton-meters (N/m) divided by basis weight.

As used herein, the term "Burst Index" refers to the quotient of burst strength, generally expressed in kilopascals (kPa) divided by basis weight, generally expressed in grams per square meter (gsm).

As used herein, the term "corrugated medium test", (CMT) refers to the crushing resistance of a fluted strip of corrugating medium, generally expressed in pound-force (lbf) or Newton (N).

As used herein, the term "ring crush" refers to the resistance of the paper and paperboard to edgewise compression, generally expressed in kilonewton per meter (kN/m).

As used herein, the term "compression" refers to the ability of corrugated shipping containers to resist external compressive forces, which is related to the stacking strength of the containers being subjected to forces encountered during transportation and warehousing. It is generally expressed in Newton (N).

As used herein, the term "edge crush" refers to the edgewise compression strength, parallel to the flutes of the corrugated board, generally expressed in kilonewton per meter (kN/m).

As used herein the term "web-forming apparatus" generally includes fourdrinier former, twin wire former, cylinder machine, press former, crescent former, and the like, known to those skilled in the arts.

As used herein the term "Canadian standard freeness" (CSF) refers generally to the rate at which slurry of fibers drains and is measured as described in TAPPI standard test method T 227 OM-09. The unit for the CSF is mL.

Straws (wheat, rice, oat, barley, rye, flax and grass) and stalks (corn, sorghum and cotton) represent potential worldwide large sources (more than 1 million dry metric tons annually) of agricultural crop-based alternative natural fibers, respectively. With any annual crop, harvesting must be done at a certain time and storage, drying, cleaning and separating are needed prior to product manufacturing. Advantages of using annual growth lignocellulosic fibers for corrugated medium applications are 1) a much shorter harvest cycle than traditional wood-based pulp sources, 2) low cost due to its residual nature, 3) no need of fiber bleaching requires less energy consumption and 4) pulling carbon dioxide out of the air to reduce global greenhouse gas effect, which enhances environmental sustainability. With these well-deserved, ecofriendly characteristics of non-wood natural fibers, companies worldwide have been quickly to integrate agro-fibers into product lines.

The present invention relates to at least one non-wood alternative pulp material to be used in containerboard packaging to replace a major portion of conventional fiber materials that are used in making corrugated medium, medium fluting and case conversion. Alternative natural fibers such as using field crop fibers or agricultural residues instead of wood fibers are considered as being more sustainable. Examples of non-wood natural materials of the present invention include, but are not limited to, wheat straw, rice straw, flax, bamboo, cotton, jute, hemp, sisal, bagasse, hesperaloe, switchgrass, miscanthus, marine or fresh water algae/seaweeds, and combinations thereof. The composition of the present invention comprises at least one non-wood alternative pulp material is selected from seaweeds such as red algae, corn stover, straw, wherein said straws are selected from wheat, rice, oat, barley, rye, flax and grass, and combinations thereof; other land-based natural fibers, said other land-based natural fibers selected from flax, bamboo, cotton, jute, hemp, sisal, bagasse, kenaf, hesperaloe, switchgrass and miscanthus, and combinations thereof; and combinations thereof. The individual fibrous material from those non-wood materials can be derived from conventional pulping processes such as thermal mechanical pulping, Kraft pulping, chemical pulping, enzyme-assisted biological pulping or organosolv pulping known in the arts. Red algae pulping (U.S. Pat. No. 7,622,019 to You et al.) on the other hand, involves less energy and capital cost because it does not contain lignin, which makes red algae distinctively different from other pulp materials. Additionally, a low basis weight is achievable when red algal fiber is used in hybrid compositions.

Corrugated medium is typically made with a semi-chemical pulp or recycled material. About 75% of production within the current production practices utilizes about 80% semi-chemical pulp and 20% recycled fiber. The remainder of the production is made of 100% recycled material and is often termed "bogus medium". Corrugated medium is a light weight board used for the fluted inner plies of corrugated box stock. The basis weight for corrugating medium ranges from about 18 pounds to about 36 pounds per 1000 $ft^2$. The preferred basis weight is about 26 to about 32 pounds per 1000 $ft^2$. The corrugated medium of the present invention may have a basis weight from about 90 $g/m^2$ to about 200 $g/m^2$.

Figure 2:
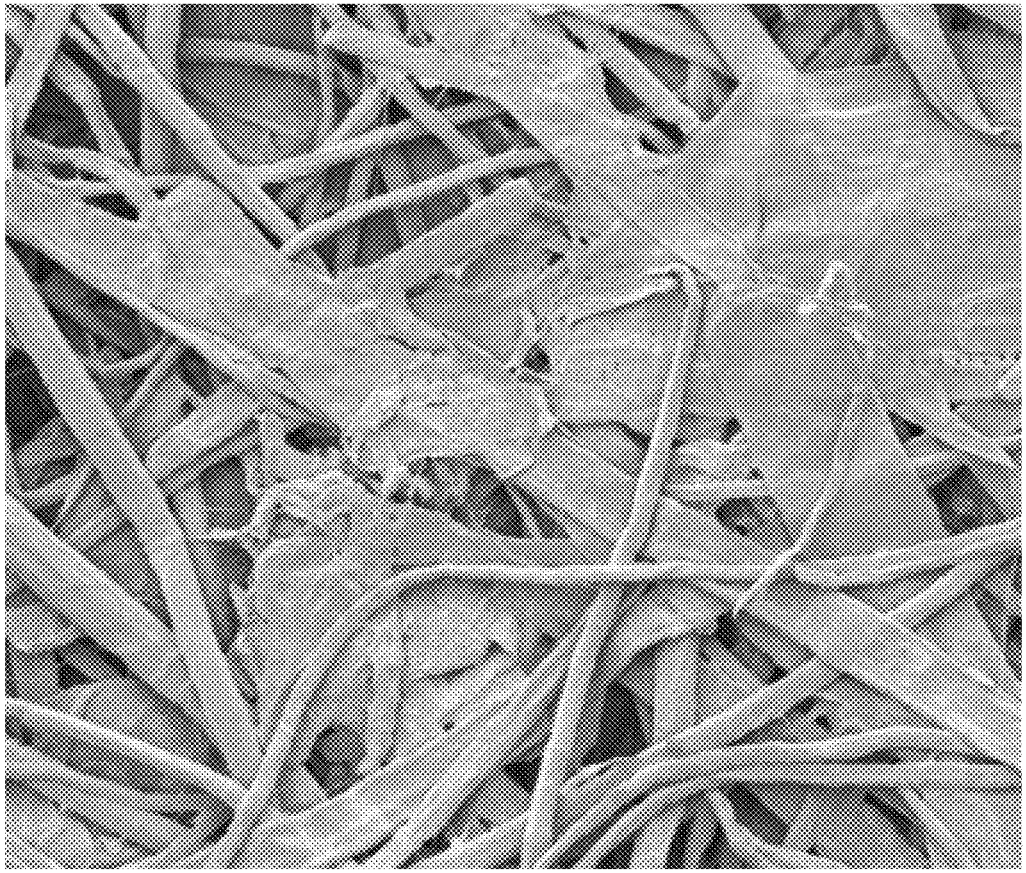
FIG. 2 shows a micrograph of 100% wheat straw fiber in a handsheet surface SEM at 300×.
Figure 3:
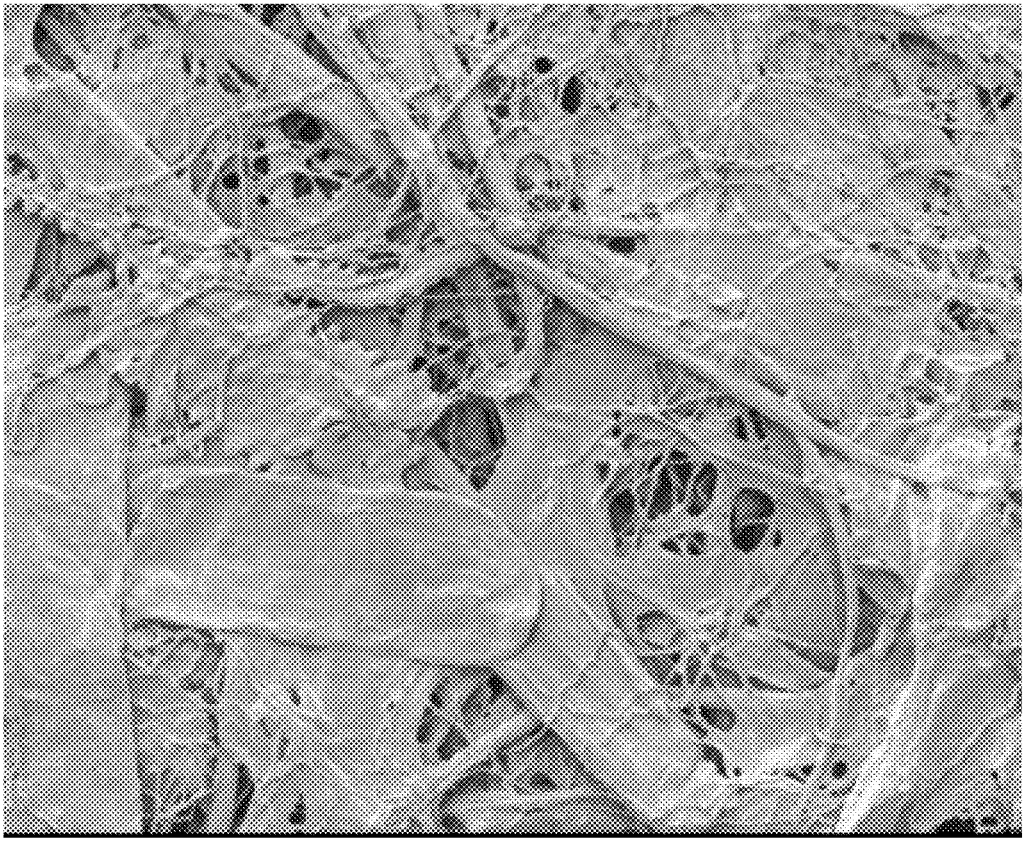
FIG. 3 shows a micrograph of a hybrid fiber composition for a handsheet surface wherein the composition contains a combination of hardwood, wheat straw and red algae fibers SEM at 300×.

The non-wood alternative pulp material of the present invention is a unique blend comprising non-wood alternative natural pulp fibers. For example, there may be a combination of hardwood and at least one non-wood alternative natural pulp fiber such as wheat straw or a combination of one or more non-wood alternative natural pulp fibers such as wheat straw and algae that are useful as the present invention. Not only does such a blend provide an advantage to manufacturing and environmentally sustainable containerboard packaging, it also strengthens the connection of the other fibers within the blend due to the presence of seaweed red algae fiber. Thus, overall mechanical properties of the corrugated medium and containerboard are improved with the use of non-wood alternative natural fibers. A comparative view of such distinctions can be seen in FIGS. 1 and 2 versus FIG. 3. Although FIG. 2 shows less patching and improved strength as compared to FIG. 1, the most enhanced fiber morphology can be seen in FIG. 3 where it shows that the presence of red algae (as represented by the tiny, thread-like fiber), strengthens the connection of semi-chemical hardwood and wheat straw fibers through strong hydrogen bonding and large surface area contacts offered by small red algae fibers.

A key distinction is red algal fiber high aspect ratio at 80 or greater relative to hardwood or wheat straw fibers. The hardwood fiber length ranges from about 1 mm to about 1.85 mm. In the case for the OCC fiber length, it is closer to the high end of the range but gets shorter as a number of recycle increases. Cereal wheat straw fiber length ranges from about 0.8 to about 1.1 mm. It is commonly understood in the arts the untreated shorter fiber and high primary fines content of wheat straw would not improve finish product mechanical properties such as tensile, tear, burst, etc. The longer the average fiber length in the paper, the stronger the sheet will be. One can add strength aids to improve the bonding of short fibers, but in general whenever a long fiber is substituted with a shorter one, the strength will decrease. Therefore, a successful substitution of conventional fibers (hardwood or OCC) used for making corrugated mediums with wheat straw fiber must rely on other fibers or chemistries. In this invention, embodiments are given to show fiber substitution is unexpectedly achievable when the red algae fiber is incorporated in hybrid fibrous compositions. The slender red algae fiber provides more surface contact areas among a network of other dissimilar fibers via hydrogen bonding to achieve a strength enhancement. Compositions of the present invention may comprise red algae as the non-wood alternative natural pulp. Red algae may be selected from *Gelidium elegance, Gelidium corneum, Gelidium amansii, Gelidium robustum, Gelidium chilense, Gracelaria verrucosa, Eucheuma Cottonii, Eucheuma Spinosum, Beludul*, and combinations thereof.

The pulp material compositions of the present invention may comprise various amounts of non-wood alternative natural pulp fibers. The composition may have a combination of elements where there is at least one non-wood alternative natural pulp fiber alone or it may be combined with a wood pulp fiber. For example, the amount of non-wood alternative natural pulp fibers of the present invention may be present in an amount of from about 5%, from about 10%, from about 20%, from about 25%, from about 30% to about 40%, to about 50%, to about 60%, to about 75%, to about 100% by weight of the composition. The pulp material compositions of the present invention may also comprise a hardwood, short fiber pulp in an amount of from about 5%, from about 10%, from about 20%, or from about 30%, to about 40%, to about 50%, to about 60% or to about 70%, by weight of the composition. When the non-wood alternative pulp materials are present alone, in combination with each other or in combination with a wood pulp fiber, the composition can then be used for a containerboard packaging that replaces a portion of conventional fiber materials.

Compositions of the present invention may show combinations, although not limited to, wherein the chemical hardwood pulp:non-wood alternative natural pulp ratio may be from about 70:30, from about 60:40, from about 50:50, from about 30:70, from about 5:95 or from about 0:100. Within any of the non-wood alternative natural pulp, there may the use of one type of non-wood alternative natural pulp or two or more in combination. For example, a composition may comprise a 30:70 ratio of hardwood:non-wood alternative natural pulp wherein the non-wood alternative is wheat straw alone or a combination of wheat straw and red algae. As mentioned, any combination of non-wood alternative natural pulps may also be used.

This invention was further demonstrated through corrugated medium papermaking, fluting and case conversion. For example, in papermaking, embodiments of hardwood pulp and wheat straw (30:70) and 100% OCC papers at a low basis weight of 112 g/m$^2$ were made as a basis for comparison, respectively. Another example of the same 30% hardwood inclusion with a balance of 70% combination of wheat straw and red algae (85.7:14.3) was made on a pilot paper machine. A cationic starch was used as a dry strength additive from about 0.1%, from about 0.5%, from about 0.1% to about 2%, to about 5%, by weight of the composition. Any starch derived from corn, wheat or potato, etc. would be suitable after cationic modification.

In fluting, linerboard was a flat facing standard material from containerboard industry, which is assembled together with the corrugated medium (wavy) using a pilot corrugator. Average line speeds of 76 meter per minute were maintained throughout the fluting and containerboard sheet assembly operation. Water soluble corn starch-based adhesives and some resins such as polyvinyl acetate may be used as adhesives. There are several configurations for containerboard: "single face", "single wall", "double face", "double wall" and "triple wall". Each configuration has special applications. Flutes come in several standard shapes or flute profiles. Different flute profiles can be combined in one piece of combined board. For instance, in a triple wall board, one layer of medium might be A-flute while the other two layers may be C-flute. Mixing flute profiles in this way allows designers to manipulate the compression strength, cushioning strength and total thickness of the combined board.

Case sizes of 34.4 cm×34.3 cm×39.1 cm. were converted using containerboard sheets by a flexo-folder-gluer press with scores and slots applied prior to gluing of manufacturer joint. Several tests such as edge crush, ring crush and three dimensional compression tests [top to bottom (T-B), end to end (E-E) and side to side (S-S)] were selected to evaluate corrugated containerboard boxes. The results for the corrugated medium containing non-wood natural fibers all exceed control samples.

All handsheet samples and samples produced from pilot machines were selectively tested for their mechanical properties (tear, tensile, burst and density) using TAPPI T220, basis weight TAPPI T410, ring crush using TAPPI T822, edge crush using TAPPI T839, corrugated medium testing using TAPPI T809 and compression test using TAPPI T804. All samples were conditioned at 50% humidity and 75° F. for 24 hours prior to performing any tests.

EXAMPLES

The following examples further describe and demonstrate embodiments within the scope of the present invention. The examples are given solely for the purpose of illustration and are not to be construed as limitations of the present invention, as many variations thereof are possible.

Example 1

A hardwood pulp was made following a typical semi-chemical cook for corrugated medium. The hardwood chips used to make the pulp were standard northern hardwood species mixture, primarily consisting of Birch, Ash and Oak (60/30/10). Fifteen hundred oven dry grams of the mixed chips were put into a digester—Model M/K 602-2 (M/K Systems, Inc., Peabody, Mass.) with a 10% solution of sodium carbonate ($Na_2CO_3$), with a 4:1 liquor to wood ratio. The chips were ramped up to their cooking temperature of 125° C. for 60 minutes, cooked for 30 minutes at temperature and then cooled down. The cooked chips were put through a lab refiner—Model 105-A (Sprout-Waldron, Muncy, Pa.), then screened on a 0.02 cm slotted vibrating flat screen. The fibers were then centrifuged to remove water to make it ready for handsheet making.

Example 2

The mixture of the pulp from Example 1 was used to make handsheets as a control. Ten handsheets were made for each code according to TAPPI T205, where a web-forming apparatus was specified and used. The handsheet basis weight was targeted to be 112 grams per square meter (gsm) with an oven dry weight of 2.24 grams for each handsheet. Actual sample basis weight showed a significant deviation. To minimize effect of basis weight for data comparison, index values are converted based on testing data and shown in Table 1, whereas Example 1 refers a mixture semi-chemical pulp made from Example 1, WS stands for wheat straw pulp, purchased from Shandong Pulp and Paper Co., Ltd. (Jinan, China) and algae refer to red algal fiber, purchased from Pegasus International (Daejeon, Republic of Korea).

Example 3

A mixture of 70% from Example 1 and 30% non-wood alternative natural fibers (20% wheat straw pulp and 10% red algae fiber) was prepared to create handsheets. Other steps to make handsheets and parameters for handsheets are similar to Example 2, including examples shown below. Therefore, they are not repeated for the sake of brevity.

Example 4

A mixture of 50% from Example 1 and 50% non-wood alternative natural fibers (40% wheat straw pulp and 10% red algae fiber) was prepared to create handsheets.

Example 5

A mixture of 30% from Example 1 and 70% non-wood alternative natural fibers (50% wheat straw pulp and 20% red algae fiber) was prepared to create handsheets.

Example 6

A mixture of 60% from Example 1 was prepared to create handsheets containing 40% wheat straw pulp without the presence of red algae fiber.

Example 7

This is a comparative example. 100% non-wood alternative natural fiber handsheets were made without the presence of the hardwood pulp as shown in Example 1. The material composition contained 80% wheat straw pulp and 20% red algae fiber. For this non-wood natural fiber composition, handsheet tear index is weakened although other mechanical properties are comparable.

Example 8

This is a comparative example. 100% non-wood alternative natural fiber handsheets were made without the presence of the hardwood pulp as shown in Example 1. The material composition contained 90% wheat straw pulp and 10% red algae fiber. For this non-wood natural fiber composition, handsheet CMT, tear index and tensile index, etc. are all lower than control (Example 2).

Example 9

This is a comparative example. 100% non-wood alternative natural fiber handsheets were made without the presence of the hardwood pulp as shown in Example 1 or the presence of red algae fiber. The material composition contained 100% wheat straw pulp is much weaker than the control (Example 2), which cannot meet corrugated medium performance standards.

The results shown in Table 1 indicate the highest tear, tensile, and burst strength along with corrugated medium test (CMT) was found with 80% wheat straw and 20% red algae, while the lowest of these properties were found with 100% wheat straw handsheets. It looks like caliper and porosity are inversely related. Handsheet density didn't change significantly from one sample to next. Examples with improved handsheet mechanical properties (Examples 3-7) versus the control (Example 2) are indicative of this invention to permit the use of non-wood alternative fibers in corrugated medium for containerboard packaging applications. However, a completely substitution of hardwood pulp using a combination of wheat straw and red algae fibers is challenged to meet technical criteria (such as CMT, Ring Crush, Density, Tear Index, Tensile Index and Burst Index, as shown) to produce useful corrugated medium.

TABLE 1

Summary of Handsheet Mechanical Properties

| Sample | % Composition Example 1/WS/Algae | Basis Weight g/m*2 | Caliper 0.001* | CMT (N) | Ring Crush (kN/m) | Density g/cm*3 | Tear Index mN*m*2/g | Tensile Index N*m/g | Burst Index KPa m*2/g |
|---|---|---|---|---|---|---|---|---|---|
| Example 2 | 100/0/0 | 134.11 | 13.14 | 90.54 | 0.85 | 0.40 | 10.06 | 24.62 | 1.20 |
| Example 3 | 70/20/10 | 130.50 | 12.15 | 145.54 | 1.10 | 0.42 | 9.63 | 29.87 | 1.75 |
| Example 4 | 60/40/0 | 113.42 | 9.93 | 137.60 | 0.78 | 0.45 | 9.46 | 37.07 | 1.95 |
| Example 5 | 50/40/10 | 125.78 | 10.78 | 142.19 | 1.09 | 0.46 | 9.31 | 29.85 | 1.60 |
| Example 6 | 30/50/20 | 125.11 | 9.85 | 192.57 | 1.10 | 0.50 | 9.87 | 31.00 | 1.81 |
| Example 7 | 0/80/20 | 123.58 | 7.33 | 248.94 | 1.37 | 0.66 | 7.34 | 58.10 | 3.02 |
| Example 8 | 0/90/10 | 119.25 | 9.01 | 122.47 | 0.78 | 0.52 | 7.80 | 21.42 | 1.27 |
| Example 9 | 0/110/0 | 121.49 | 10.14 | 47.48 | 0.31 | 0.47 | 4.14 | 8.10 | 0.82 |

Example 10

Corrugated medium papermaking using a web-forming apparatus such as Fourdrinier 36" paper machine (Sandy Hill Corporation, Hudson Falls, N.Y.) is shown in Table 2. The Hogenkamp head box was used. The table has a forming length of 4.1 meters. The slice width is 83.8 cm and the machine is operated with edge curls. The machine's press section consists of two double-felted presses. Each press nip is pneumatically loaded. The first press is limited to 1245 per linear centimeter (plc) and the second press to 2489 plc, which is a standard measurement for pressing and calendaring. All press rolls are rubber covered and blind drilled.

The machine's dryer section consists of 2 banks of 91.4 cm diameter dryer cans, 9 cans in the first section and 5 cans in the second section. The size press sits between the dryer sections and was utilized for the trial.

Following the second dryer section is a 4 roll, 3-nip calendar stack. Two-45.7 cm diameter nylon soft and two-45.7 cm diameter hard steel rolls may be configured for calendaring in various configurations. Maximum pressure is 5080 plc and maximum temperature is 550° F.

There were three corrugated mediums produced from the pilot scale papermaking machine: Example 10A is a blend of the hardwood and wheat straw (30/70), Example 10B is 100% OCC, and Example 10C is a blend of 30% hardwood, 60% wheat straw and 10% red algae fiber. The respective fibrous compositions are shown in Table 2. A cationic starch was used in papermaking at 0.5% of fiber.

TABLE 2

Corrugated Medium Papermaking Examples and Compositions

| | Fiber Composition (%) | | | | Projected Each Pulp Weight (kg) | | | |
|---|---|---|---|---|---|---|---|---|
| Example | OCC | Hard-wood | Wheat Straw Pulp | Red Algal Fiber | OCC | Hard-wood | Wheat Straw Pulp | Red Algal Fiber |
| Example 12A | | 30 | 70 | | | 26 | 60 | |
| Example 12B | 100 | | | | 86 | | | |
| Example 12C | | 30 | 60 | 10 | | 26 | 51 | 9 |

The wheat straw pulp and red algal fiber are the same as those used in making handsheet samples. Hardwood fiber was pulped from pinnacle prime hardwood, purchased from Newpage Corporation (Miamisburg, Ohio). Its Canadian standard freeness (CSF) is reported to be 730 mL. Refining of hardwood pulp to the CSF of 350~400 mL was carried out using 16" Beloit Double Disc 4000 refiner (Beloit Corporation, Lenox Dale, Mass.) prior to papermaking. No refining was done to OCC and wheat straw materials because the CSF values were within 350~400 mL. The medium paper was targeted to be 112 g/m$^2$, medium paper width is 83.8 cm and the length of the paper is 915 meters per sample.

The papermaking speed was 0.38 to 0.48 feet per minute. Caliper for those papers are 0.015 to 0.020 centimeters. The medium paper was rolled up on 10.2 cm core size for further processing, i.e., medium fluting and container sheet assembly. The diameter for each sample roll ranged from 46 to 60 cm.

Example 11

This example is about medium paper fluting and containerboard sheet assembly using a pilot corrugator. Kraft linerboard (35 pounds per 1000 ft$^2$) was purchased from Georgia-Pacific Corporation (Atlanta, Ga.), which is made up of 20% post-consumer and 5% pre-consumer content with the balance (75%) in virgin fibers. Polyvinyl acetate is water-based adhesive, purchased from Wisdom Adhesives (Elgin, Ill.) and starch is Clinton corn starch, purchased from ADM (Decatur, Ill.). All of those materials were used in fluting medium paper and containerboard sheet assembly.

Asitrade MF250 Modulefacer was used to manufacture the corrugated containerboard that included a single face sheet (inside liner) combined with the fluted medium using an average application rate for the starch on the single face side of the sheet, which is 2.45 pounds per 1000 $ft^2$. The glue formulation is a standard corrugator industry adhesive consisting of 363 kg corn starch, 5 kg borax, 6.4 kg caustic and 871 liters of water. The single face liner was then joined with the double backer (exterior) liner to form the finished sheet using Asitrade Laminator. This involved in the use of a cold set PVA adhesive at an application rate of 4.74 pounds per 1000 $ft^2$ on B-flute. The B-flute designates flutes per linear meter of 154±10 and flute thickness of 3.2 mm. All containerboard sheets were produced in B-flute with a take-up factor of 1.31.

Example 12

Case sizes of 34.4 cm×34.3×39.1 cm were converted using containerboard sheets from Example 11 by a flexo-folder-gluer press with scores and slots applied prior to gluing of manufacturer joint.

Containers were conditioned at 50% lab humidity and 75° F. before tests listed below were conducted. Tests of container edge crush, ring crush and three dimensional compression tests for cases were conducted and the results are shown in Table 3, where T-B stands for a compression done from top of the container to the bottom, E-E stands for edge to edge and S-S stands for width to width. Respective test methods are 1) Edge Crush Test using TAPPI T839, 2) Ring Crush Test using TAPPI T822, 3) compression test using TAPPI T804 and 4) basis weight for B-flute medium, double backer and single facer using TAPPI T410.

TABLE 3

Physical Testing Results for Cases Made Using three Different Corrugated Mediums

| Containers Comprising Fluted Medium | Basis Weight (lbs/1000 $ft^2$) Medium (B-Flute) | Double Backer | Single Facer | ECT (N) | RCT (kN/m) | Three Dimensional Compresion (kg) T-B | E-E | S-S |
|---|---|---|---|---|---|---|---|---|
| Example 10A | 23 | 34 | 34 | 178 | 1.19 | 200 | 184 | 153 |
| Example 10B | 26 | 42 | 35 | 162 | 1.01 | 180 | 164 | 145 |
| Example 10C | 24 | 35 | 34 | 190 | 1.24 | 205 | 149 | 154 |

The sample basis weights for corrugated medium and single facer containerboard are similar except for 100% OCC as corrugated medium, which is slightly higher especially for double backer. A value of 22 lbs/1000 $ft^2$ is corresponding to about 112 $g/m^2$. Thus, this inventive composition also creates a light weight corrugated medium for container packaging applications. The ECT and RCT results indicate containers using a combination of wheat straw and red algae alternative natural fibers as the corrugated medium are better than wheat straw alone, where hardwood pulp is at the same level. Difference in the ECT and RCT results are reflective of the changes in medium composition because linerboards are the same material for each case assembled. The improvements in the ECT and RCT results are more pronounced when Example 10C is compared to Example 10B, which used 100% OCC as corrugated medium.

In three dimensional compression tests, E-E compression for Example 10C is weaker than 100% OCC control and hardwood and wheat straw blend. All other data (T-B and S-S compressions) are better for Example 10C, indicating red algae fiber plays an important role to enable wheat straw pulp being useful.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A containerboard packaging material comprising a paper linerboard and a fiber-based flute, wherein the linerboard comprises:

a first non-wood alternative pulp material selected from the group consisting of corn stover, straw, other land-based natural fibers, and combinations thereof and present in an amount of from about 10% to about 60%, and a second one non-wood alternative pulp material selected from seaweed and present in an amount of from about 5% to about 30%, wherein the non-wood alternative pulp material replaces at least a portion of conventional fiber materials.

2. The containerboard packaging material of claim 1, the linerboard further comprising 85% to 10% hardwood pulp.

3. The containerboard packaging material of claim 1 wherein the seaweed is selected from the group consisting of *Gelidium elegance, Gelidium corneum, Gelidium amansii,*

*Gelidium robustum, Gelidium chilense, Gracelaria verrucosa, Eucheuma Cottonii, Eucheuma Spinosum, Beludul*, and combinations thereof.

4. The containerboard packaging material of claim 1, wherein the first non-wood alternative pulp material is wheat straw and the second non-wood alternative pulp material is red algae, with the linerboard comprising from about 20% to about 75% of wheat straw and red algae pulp combined.

5. The containerboard packaging material of claim 1, the linerboard comprising from about 5% to about 30% seaweed red algae pulp and from about 25% to about 90% hardwood pulp fibers.

6. The containerboard packaging material of claim 1, wherein the flute comprises corrugated medium that has basis weight from about 90 $g/m^2$ to about 200 $g/m^2$.

7. The containerboard packaging material of claim 1, further comprising an adhesive selected from the group consisting of starch, polyvinyl acetate, and combinations thereof.

8. The containerboard packaging material of claim 1, wherein the flute ranges in size from about 105 flutes per meter to about 420 flutes per meter.

9. The containerboard packaging material of claim 7 wherein said material is converted into rigid packaging containers suitable for packaging applications.

10. The containerboard packaging material of claim 1 wherein the ratio of hardwood pulp to non-wood alternative pulp is from about 30:70 to about 5:95.

11. The containerboard packaging material of claim 1, wherein the straw is selected from the group consisting of wheat, rice, oat, barley, rye, flax, grass, and combinations thereof.

12. The containerboard packaging material of claim 1, wherein the other land-based natural fibers are selected from the group consisting of flax, bamboo, cotton, jute, hemp, sisal, bagasse, kenaf, hesperaloe, switchgrass, miscanthus, and combinations thereof.

* * * * *